US009400453B1

(12) United States Patent
Nimura

(10) Patent No.: US 9,400,453 B1
(45) Date of Patent: Jul. 26, 2016

(54) DEVELOPING DEVICE AND IMAGE FORMING APPARATUS THEREWITH, AND DEVELOPER CARRYING MEMBER THEREIN

(71) Applicant: KYOCERA Document Solutions Inc., Osaka (JP)

(72) Inventor: Eiji Nimura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/964,077

(22) Filed: Dec. 9, 2015

(30) Foreign Application Priority Data

Feb. 19, 2015 (JP) ..... 2015-030254

(51) Int. Cl.
*G03G 15/09* (2006.01)

(52) U.S. Cl.
CPC ..... *G03G 15/0928* (2013.01); *G03G 15/0921* (2013.01)

(58) Field of Classification Search
CPC ..... G03G 15/09; G03G 15/0914; G03G 15/0921; G03G 15/0928
USPC ..... 399/277, 267
See application file for complete search history.

(56) References Cited

U.S. PATENT DOCUMENTS 4,557,582 A * 12/1985 Kan ..... G03G 15/0921 399/277 X
5,991,585 A * 11/1999 Nakamura ..... G03G 15/0921 399/267
6,070,038 A * 5/2000 Imamura ..... G03G 15/0921 399/277
2007/0292165 A1* 12/2007 Hirayama ..... G03G 15/0815 399/267
2008/0050671 A1* 2/2008 Yamazaki ..... G03G 15/0808 399/267 X

FOREIGN PATENT DOCUMENTS

JP 2000-75665 A 3/2000

OTHER PUBLICATIONS

Machine translation of JP 2000-075665 (published on Mar. 14, 2000), printed on Apr. 20, 2016.*

* cited by examiner

*Primary Examiner* — Sophia S Chen
(74) *Attorney, Agent, or Firm* — Stein IP, LLC

(57) ABSTRACT

A developing device includes a housing, a developer carrying member, and a magnet member. The housing contains magnetic developer. The developer carrying member is rotatably supported on the housing and carries the developer on its circumferential surface. The magnetic member has a shaft fixed inside the developer carrying member and a plurality of developer carrying member-side magnetic poles fixed to the shaft in its circumferential direction. An even number of the developer carrying member-side magnetic poles are formed by plastic magnets, one or more other of the developer carrying member-side magnetic poles are formed by rubber magnets, and one or more pairs of the plastic magnets located opposite each other across the shaft have the same shape and are fixed in axial symmetry with respect to the shaft.

3 Claims, 6 Drawing Sheets

--Related Art--

--Related Art--

DEVELOPING DEVICE AND IMAGE FORMING APPARATUS THEREWITH, AND DEVELOPER CARRYING MEMBER THEREIN

INCORPORATION BY REFERENCE

This application is based upon and claims the benefit of priority from the corresponding Japanese Patent Application No. 2015-030254 filed on Feb. 19, 2015, the entire contents of which are incorporated herein by reference.

BACKGROUND

The present disclosure relates to an image forming apparatus such as a copier, a printer, a facsimile machine, etc., and to a developing device and a developer carrying member that are incorporated in such an image forming apparatus. More particularly, the present disclosure relates to a method for suppressing deformation of a fixed magnet member arranged in a developer carrying member.

In one conventionally common process as an image developing system in image forming apparatuses exploiting an electrophotographic process, powder developer is mainly used, an electrostatic latent image formed on an image carrying member such as a photosensitive drum is made visible with the developer, and the visible image (toner image) is transferred to a recording medium and is then fixed.

Developer is roughly classified into two-component developer containing toner and magnetic carrier and one-component developer containing non-magnetic or magnetic toner alone. In one known developing system using two-component developer, a magnet (magnetic pole) having a magnetic field that varies in strength in the circumferential direction is fixed to a central part of a developing roller (developer carrying member), and a metal regulating blade is arranged opposite the surface of the developing roller across a gap of several hundred micrometers.

On the other hand, as a developing system using one-component developer, a so-called jumping one-component developing system is known in which a fixed magnet member having a plurality of magnetic poles is arranged inside a developing roller, toner in a developer container is carried on the developing roller by use of a magnetic carrying force, a thin layer of toner is formed through layer thickness regulation by use of a regulating blade, and toner is made to fly to the photosensitive drum at a developing position.

In recent years, as a magnet that is arranged inside a developing roller, a plastic magnet formed of a resin material having magnetic powder dispersed in it is used. Plastic magnets can hold higher magnetic forces in small volumes as compared with rubber magnets. Plastic magnets, however, are more expensive than rubber magnets.

As a compromise, configurations are known in which, for example, as a magnetic pole which requires a strong magnetic force such as a main magnetic pole, a plastic magnet is arranged, and as a sub-magnetic pole, an inexpensive rubber magnet is arranged.

SUMMARY

According to one aspect of the present disclosure, a developing device includes a housing, a developer carrying member, and a magnet member. The housing contains magnetic developer. The developer carrying member is rotatably supported on the housing and carries the developer on its circumferential surface. The magnetic member has a shaft fixed inside the developer carrying member and a plurality of developer carrying member-side magnetic poles fixed to the shaft in its circumferential direction. An even number of the developer carrying member-side magnetic poles are formed by plastic magnets, one or more other of the developer carrying member-side magnetic poles are formed by rubber magnets, and one or more pairs of the plastic magnets located opposite each other across the shaft have the same shape and are fixed in axial symmetry with respect to the shaft.

Further features and advantages of the present disclosure will become apparent from the description of embodiments given below.

DETAILED DESCRIPTION

Figure 1:
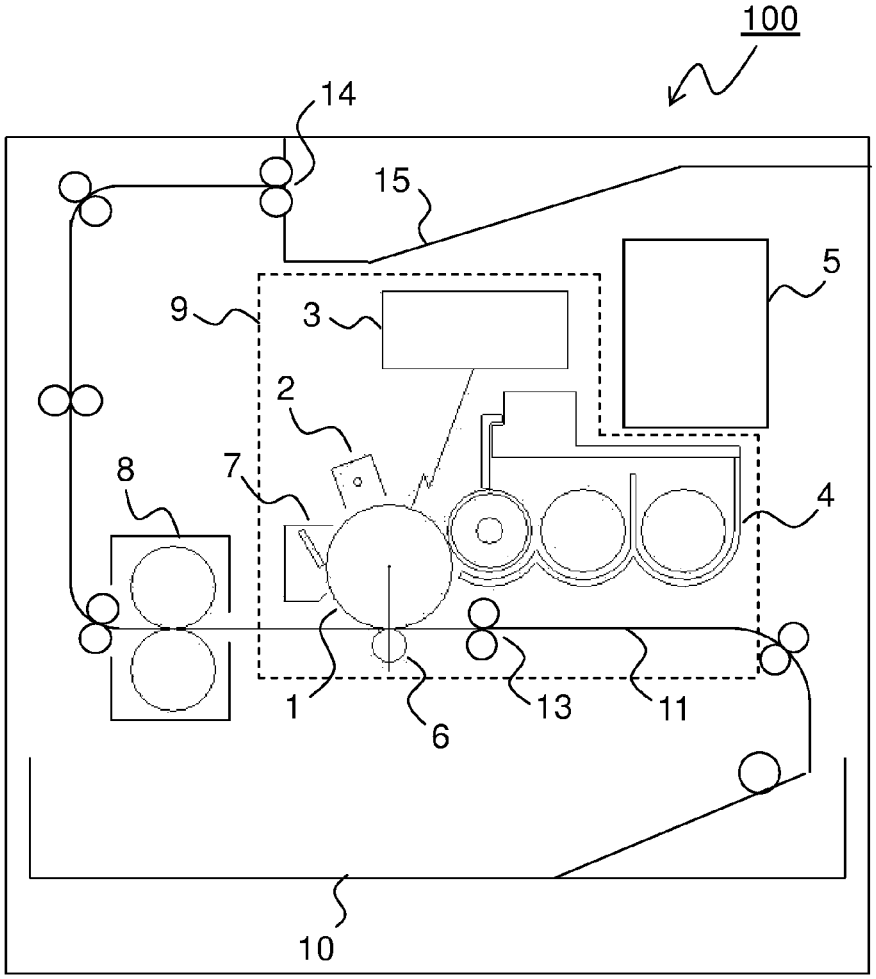
FIG. 1 is a schematic sectional view of an image forming apparatus 100 provided with a developing device 4 according to one embodiment of the present disclosure.

Hereinafter, embodiments of the present disclosure will be described with reference to the accompanying drawings. FIG. 1 is a schematic sectional view of an image forming apparatus 100 provided with a developing device 4 according to one embodiment of the present disclosure. In the image forming apparatus (for example, a monochrome printer) 100, when a copy operation is performed, in an image forming section 9 inside the apparatus main body, an electrostatic latent image based on document image data transmitted from an unillustrated personal computer (PC) is formed, and the developing device 4 attaches toner to the electrostatic latent image to form a toner image. The toner is fed to the developing device 4 from a toner container 5. In the image forming apparatus 100, while a photosensitive drum 1 is rotated in a clockwise direction in FIG. 1, an image forming process is executed with respect to the photosensitive drum 1.

In the image forming section 9, there are arranged, along the rotation direction (clockwise direction) of the photosensitive drum 1, a charging device 2, an exposure unit 3, a developing device 4, a transfer roller 6, a cleaning device 7, and a static eliminator (unillustrated). The photosensitive drum 1 is, for example, an aluminum drum laid with a photosensitive layer, and its surface is electrostatically charged by the charging device 2 uniformly. On the surface, when it receives a laser beam from the exposure unit 3, which will be described later, an electrostatic latent image with attenuated electric charge is formed. There is no particular restriction on the photosensitive layer, which preferably is, for example, a layer of amorphous silicon (a-Si), which excels in durability, or the like.

The charging device 2 serves to electrostatically charge the surface of the photosensitive drum 1 uniformly. For example, as the charging portion 2, a corona discharging device which achieves electrical discharge by application of a high voltage to a thin piece of wire or the like as an electrode is used. In place of the corona discharging device, a contact-type charging device which applies a voltage while keeping the surface of a photosensitive member in contact with a charging member as exemplified by a charging roller can be used. The exposure unit 3 forms an electrostatic latent image on the surface of the photosensitive drum 1 by irradiating the photosensitive drum 1 with a light beam (for example, a laser beam) based on the image data.

The developing device 4 serves to form a toner image by attaching toner to the electrostatic latent image on the photosensitive drum 1. In this embodiment, magnetic one-component developer (hereinafter also referred to as developer or toner) containing magnetic toner is stored in the developing device 4. The details of the developing device 4 will be described later. The cleaning device 7 is provided with a cleaning roller, a cleaning blade, or the like that makes line contact with the photosensitive drum 1 in its longitudinal direction (the direction perpendicular to the plane of FIG. 1), and serves to remove toner (unused toner) left behind on the surface of the photosensitive drum 1 after the toner image has been moved (transferred) to a sheet.

Toward the photosensitive drum 1 on which the toner image has been formed as described above, a sheet is transported with predetermined timing from a sheet storage portion 10 via a sheet transport passage 11 and a registration roller pair 13 to the image forming section 9. The transfer roller 6 moves (transfers), without disturbing, the toner image formed on the surface of the photosensitive drum 1 to a sheet transported through the sheet transport passage 11. Thereafter, in preparation for subsequent formation of a new electrostatic latent image, the cleaning device 7 removes unused toner on the surface of the photosensitive drum 1, and the static eliminator cancels out residual electric charge.

The sheet to which the toner image has been transferred is separated from the photosensitive drum 1 and is transported to a fixing device 8, where heat and pressure are applied and thereby the toner image is fixed on the sheet. The sheet which has passed through the fixing device 8 passes through a discharge roller pair 14 and is discharged onto a sheet discharge portion 15.

Figure 2A:
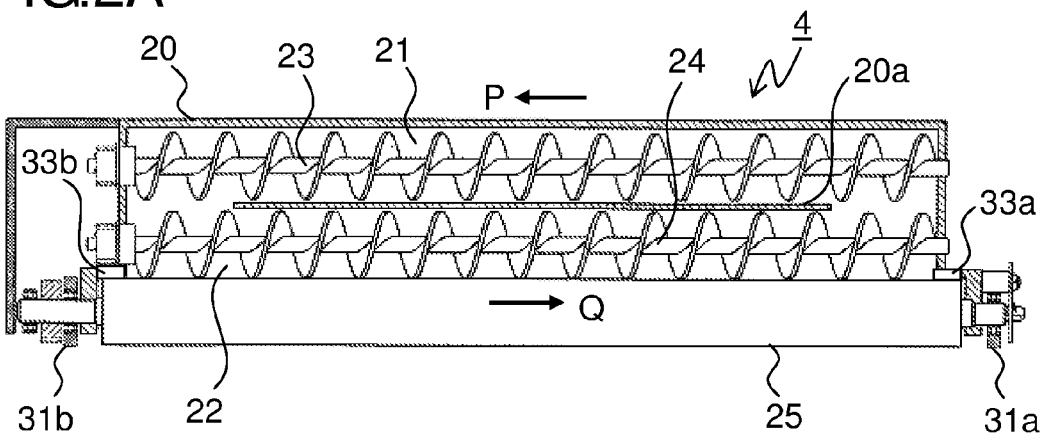
FIG. 2A is a plan view of a developing device 4.
Figure 2B:
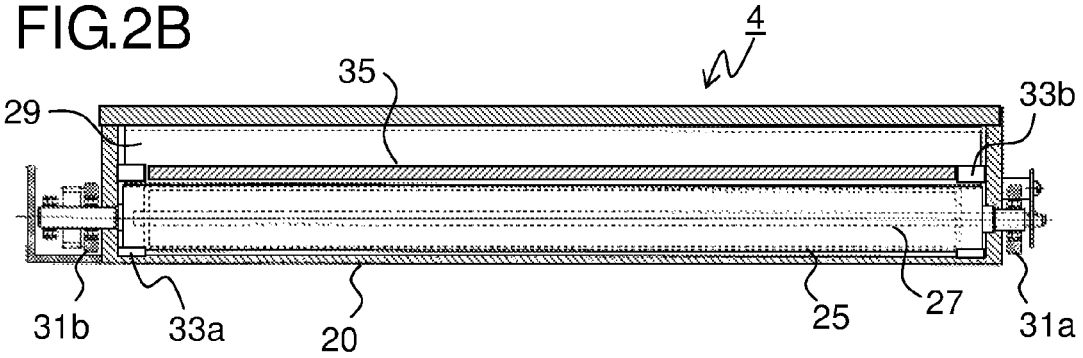
FIG. 2B is a front view of a developing device 4.
Figure 3:
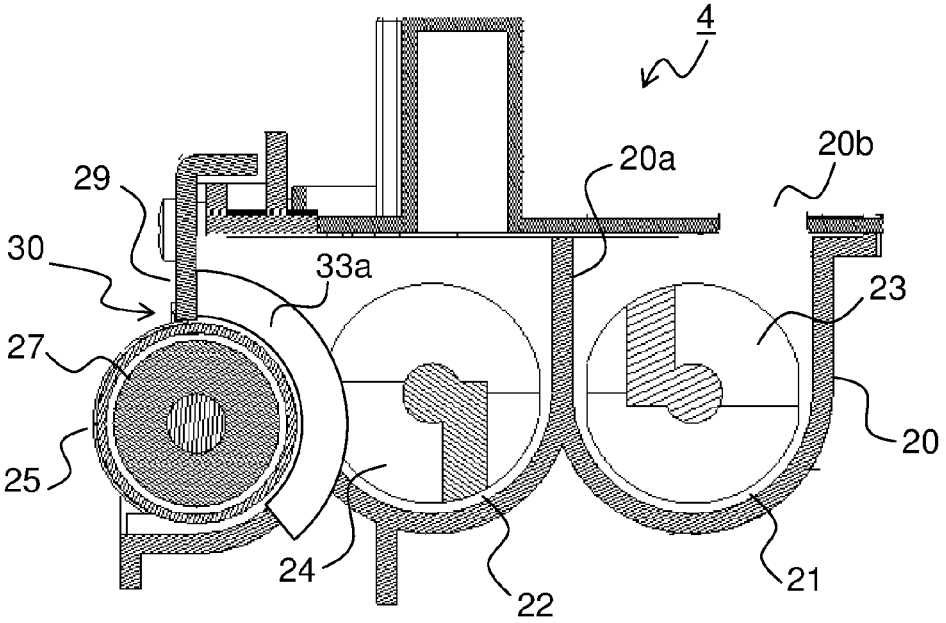
FIG. 3 is a side sectional view of a developing device 4.

FIGS. 2A and 2B are respectively a plan view and a front view of the developing device 4 according to the embodiment; FIG. 3 is a side sectional view of the developing device 4. In FIG. 2A, for the sake of convenience, the top cover is removed so that the interior is visible. As shown in FIGS. 2A, 2B, and 3, the interior of a housing 20 is divided, by a partition wall 20*a* formed integrally with the housing 20, into a first storage chamber 21 and a second storage chamber 22. In the first storage chamber 21, a first stirring screw 23 is arranged; in the second storage chamber 22, a second stirring screw 24 is arranged.

The first stirring screw 23 and the second stirring screw 24 are each composed of a helical blade arranged around a support shaft (rotary shaft), and are rotatably supported on the housing 20 parallel to each other. As shown in FIG. 2A, in opposite end parts of the housing 20 in its longitudinal direction, that is, in the axial direction of the first stirring screw 23 and the second stirring screw 24, no partition wall 20*a* is provided, and this permits passage of toner between the first stirring screw 23 and the second stirring screw 24. Thus, the first stirring screw 23 transports, while stirring, developer in the first storage chamber 21 in the direction indicated by arrow P, and then transports the developer to the second storage chamber 22. The second stirring screw 24 transports, while stirring, the developer transported to the second storage chamber 22 in the direction indicated by arrow Q, and feeds the developer to a developing roller 25.

The developing roller 25 rotates as the photosensitive drum 1 (see FIG. 1) rotates, and thereby feeds developer to the photosensitive layer of the photosensitive drum 1. Inside the developing roller 25, a fixed magnet member 27 is fixed which comprises a permanent magnet having a plurality of magnetic poles. By the magnetic force of the fixed magnet member 27, developer is attached (carried) on the surface of the developing roller 25, thereby forming a magnetic brush. The developing roller 25 is rotatably supported on the housing 20 so as to be parallel to the first stirring screw 23 and the second stirring screw 24. The first stirring screw 23, the second stirring screw 24, and the developing roller 25 are driven to rotate by a motor (unillustrated).

A regulating blade 29 is formed so as to be, in its longitudinal direction (the left/right direction in FIG. 2B), larger than the maximum developing width. As a result of the regulating blade 29 being arranged at a predetermined distance from the developing roller 25, a regulating portion 30 is formed which regulates the amount of developer fed to the photosensitive drum 1. The regulating blade 29 is formed of a magnetic material such as SUS (stainless steel).

On the bottom surface of the second storage chamber 22 facing the second stirring screw 24, a developer amount detecting sensor (unillustrated) is provided which detects the amount of developer stored in the housing 20. According to the result of detection by the developer amount detecting sensor, the developer stored in the toner container 5 (see FIG. 1) is fed through a developer feeding port 20*b* provided at an upper part of the housing 20 into the housing 20.

Around the rotary shaft of the developing roller 25, DS rollers 31*a* and 31*b* are rotatably fitted. The DS rollers 31*a* and 31*b* make contact with the photosensitive drum 1 at opposite end parts of the circumferential surface thereof so as to strictly regulate the distance between the developing roller 25 and the photosensitive drum 1. The DS rollers 31*a* and 31*b* each incorporate a bearing, and rotate by following the photosensitive drum 1 as it rotates; this helps prevent wear on the drum surface. At opposite end parts of the developing roller 25, magnetic sealing members 33*a* and 33*b* are arranged for preventing developer from leaking through a gap between the housing 20 and the developing roller 25.

Figure 9:
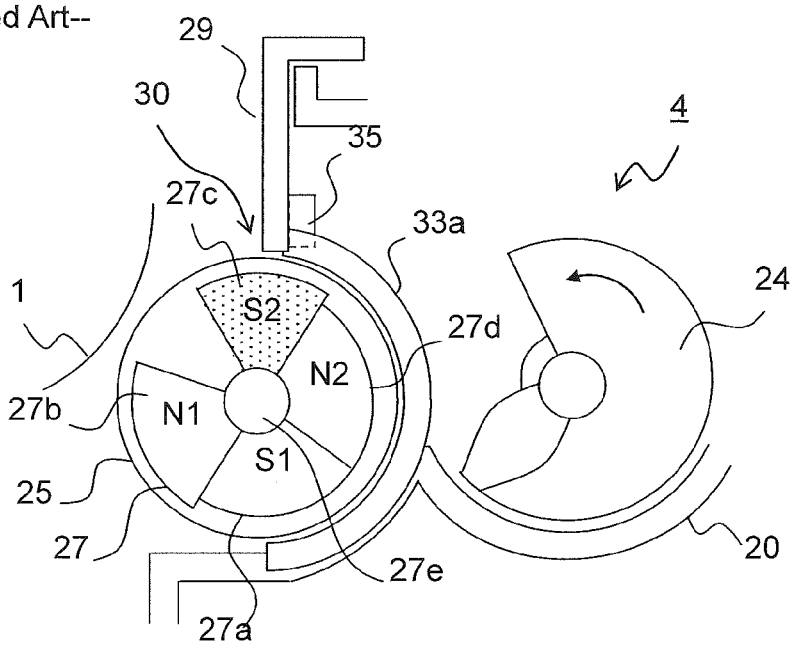
FIG. 9 is an enlarged view of and around a developing roller 25 in a conventional developing device 4 where a plastic magnet is used as an S2 pole 27*c* facing a regulating blade 29 and rubber magnets are used as other poles, namely an S1 pole 27*a*, an N1 pole 27*b*, and an N2 pole 27*d*.

FIG. 9 is an enlarged view of and around a developing roller 25 in a conventional developing device 4 where a plastic magnet is used as a S2 pole (regulating pole) 27*c* facing the regulating blade 29 and a rubber magnet is used as each of a S1 pole 27*a*, a N1 pole 27*b*, and a N2 pole 27*d*. When, as shown in FIG. 9, a plastic magnet is bonded and thereby fixed to a metal shaft 27*e* to form the fixed magnet member 27, due to a difference in thermal expansion coefficient between the shaft 27*e* and the plastic magnet, the shaft 27*e* warps by being influenced by thermal deformation of the plastic magnet. To reduce the warp of the shaft 27*e*, it is necessary to minimize the area over which the shaft 27*e* and the plastic magnet are bonded together; however, even when, for example, the bonding width is as small as 100 mm, the amount of deformation is about 0.2 mm for a 20° C. rise; that is, considerable deformation still occurs even with a small bonding area.

Figure 10:
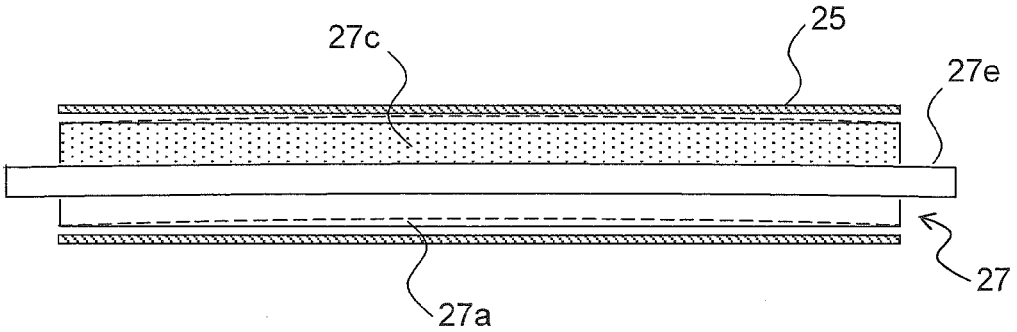
FIG. 10 is a sectional view of a shaft 27*e* of a fixed magnet member 27 in a warped state in the developing device 4 shown in FIG. 9 as seen from the direction perpendicular to the axial direction of the developing roller 25.

When such a fixed magnet member 27 is arranged in the developing roller 25, due to a narrow gap between the developing roller 25 and the fixed magnet member 27, as shown in FIG. 10, the shaft 27*e* warps, and causes the fixed magnet member 27 to make contact with the inner surface of the developing roller 25. In particular, in a magnetic one-component developing system, the S2 pole 27*c* facing the regulating blade 29 is required to have a strong magnetic force, and thus typically a plastic magnet is used as the S2 pole 27*c* and a magnetic blade is used as the regulating blade 29. As a result, a warp due to a magnetic force adds to the warp due to thermal deformation, making the fixed magnet member 27 more likely to make contact with the developing roller 25. When the fixed magnet member 27 makes contact with the developing roller 25, abnormal noise may be generated and image defects may be caused due to defective rotation of the developing roller 25.

Moreover, increasing an inner diameter of the developing roller 25 to avoid contact between the developing roller 25 and the fixed magnet member 27 results in reducing a magnetic force on the surface of the developing roller 25 produced by the fixed magnet member 27. As a solution, in the developing device 4 according to the present disclosure, the shape and arrangement of a plastic magnet or a rubber magnet fixed on a shaft 27*e* of the fixed magnet member 27 are so devised as to prevent deformation of the shaft 27*e*.

Figure 4:
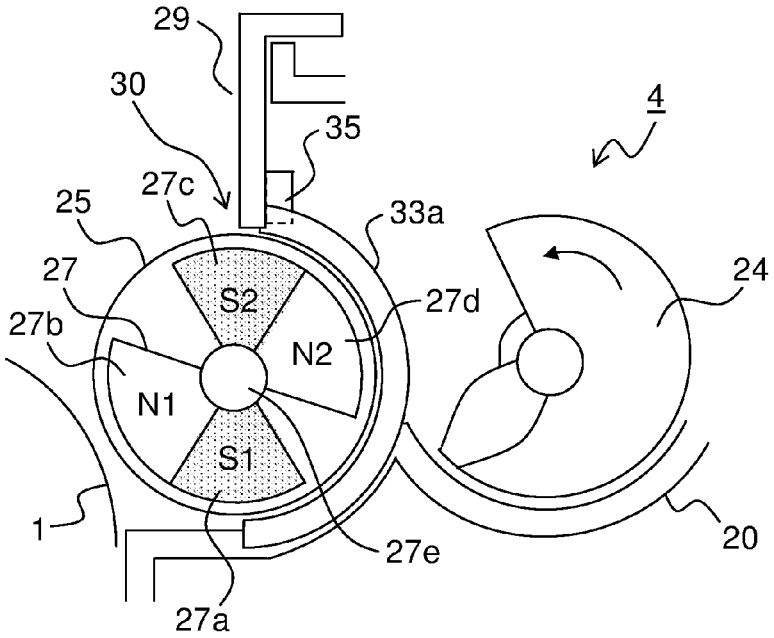
FIG. 4 is an enlarged view of and around a developing roller 25 in a developing device 4 according to a first embodiment of the present disclosure.
Figure 5:
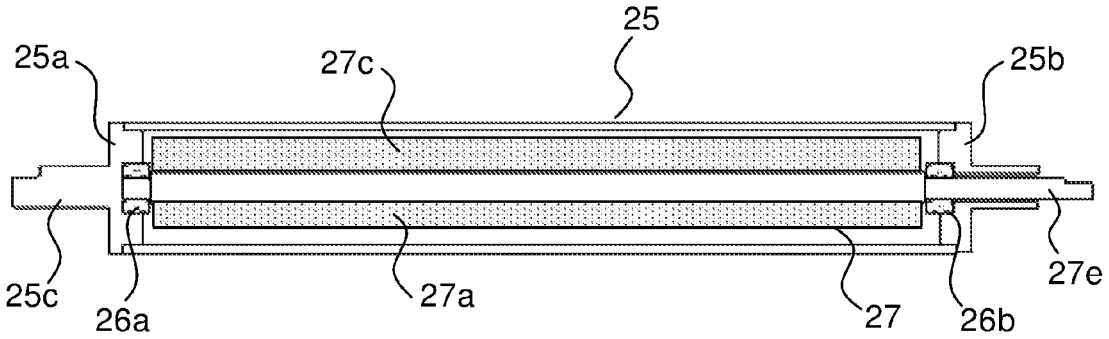
FIG. 5 is a sectional view of the developing roller 25 shown in FIG. 4 as seen from the direction perpendicular to the axial direction.

FIG. 4 is an enlarged view of and around the developing roller 25 in the developing device 4 according to a first embodiment of the present disclosure; FIG. 5 is a sectional view of the developing roller 25 shown in FIG. 4 as seen from the direction perpendicular to the axial direction. As shown in FIG. 4, the fixed magnet member 27 has four magnetic poles 27*a* to 27*d*, namely an S1 pole 27*a*, an S2 pole 27*c*, an N1 pole 27*b*, and an N2 pole 27*d*, fixed to the metal shaft 27*e*. Of the magnetic poles 27*a* to 27*d*, as the S1 pole 27*a* and the S2 pole 27*c*, plastic magnets are used, and as the N1 pole 27*b* and the N2 pole 27*d*, rubber magnets are used.

As shown in FIG. 5, on opposite end parts of the developing roller 25 in its longitudinal direction, flange portions 25*a* and 25*b* are fitted respectively, and to the flange portion 25*a*, a driving input shaft 25*c* is fixed. One end (right end in FIG. 5) of the shaft 27*e* of the fixed magnet member 27 (see FIG. 3) is fixed to the housing 20, and between the flange portions 25*a* and 25*b* and the shaft 27*e*, bearings 26*a* and 26*b* are arranged respectively. When a rotation driving force is input to the driving input shaft 25*c* via driving input gears (unillustrated), the developing roller 25 rotates together with the flange portions 25*a* and 25*b*, whereas the fixed magnet member 27 remains at rest.

According to FIG. 4, at a vicinity of a tip end of the regulating blade 29, a blade-side magnet 35 is provided. As shown in FIGS. 2A and 2B, the blade-side magnet 35 is provided across substantially the whole area between the magnetic sealing members 33*a* and 33*b* in the longitudinal direction (left/right direction in FIGS. 2A and 2B) of the regulating blade 29. The blade-side magnet 35 with its S pole down makes contact with the regulating blade 29, and at a tip end of the regulating blade 29, an N pole is induced. Thus, a magnetic field is produced in the regulating portion 30, in an attracting direction from the S2 pole (regulating pole) 27*c* of the fixed magnet member 27.

By the magnetic field, a magnetic brush formed by developer particles linked into chains is formed between the regulating blade 29 and the developing roller 25, and when the magnetic brush passes through the regulating portion 30, its layer is regulated to a desired height. The developer left unused after the magnetic brush is formed, on the other hand, stagnates along a side surface of the regulating blade 29 on its upstream side (right side). Thereafter, when the developing roller 25 rotates in the counter-clockwise direction until the magnetic brush moves to a position (developing area) where it faces the photosensitive drum 1, a magnetic field is applied by the N1 pole 27*b* (main pole) to the magnetic brush; thus the magnetic brush makes contact with the surface of the photosensitive drum 1 and develops an electrostatic latent image.

When the developer roller 25 rotates further in the counter-clockwise direction, a magnetic field is applied by the S1 pole (transport pole) 27*a* now in a direction along the circumferential surface of the developing roller 25; thus together with the magnetic brush, the developer left unused after toner image formation is collected on the developing roller 25. Then, the magnetic brush is separated from the developing roller 25 through a hollow portion between the S1 pole 27*a* and the N2 pole 27*d*, and falls into the housing 20. Then, after stirring and transport by the second stirring screw 24, a magnetic brush is again formed on the developing roller 25 by the magnetic field from the N2 pole (draw-up pole) 27*d*.

The housing 20 which surrounds the developing roller 25 at its opposite end parts has the magnetic sealing members 33*a* and 33*b* arranged respectively. In FIG. 4, the magnetic sealing member 33*a* alone is illustrated. The magnetic sealing members 33*a* and 33*b* are, as shown in FIG. 4, in a non-contact state with the developing roller 25, that is, they are arranged at the opposite end parts of the developing roller 25 with a predetermined distance (gap) from the circumferential surface of the developing roller 25. The magnetic sealing members 33*a* and 33*b* are arranged on the opposite side of the developing roller 25 from the photosensitive drum 1 across.

In this embodiment, plastic magnets in the same shape are used as the 51 pole 27*a* and the S2 pole 27*c*, and are arranged in axial symmetry with respect to the shaft 27*e*. Thus, when the S1 pole 27*a* and the S2 pole 27*c* expand or contract due to change in temperature, a force acts on the shaft 27*e* uniformly from the axisymmetric directions (up/down directions in FIG. 5). As a result, the shaft 27*e* can be prevented from warping due to thermal deformation of the magnetic poles 27*a* and 27*c*.

In the developing device 4 adopting a one-component developing system, it is important to form a layer of toner having uniform thickness on the developing roller 25 in the regulating portion 30, and thus to prevent defective formation of the toner layer, the S2 pole (regulating pole) 27*c* facing the regulating blade 29 is required to have a strong magnetic force. Accordingly, in this embodiment, plastic magnets in the same shape are used as the S2 pole 27*c* arranged at a position where the developing roller 25 and the regulating blade 29 are close together and as the S1 pole 27*a* arranged opposite the S2 pole 27*c* across the shaft 27*e*, and are arranged in axial symmetry with respect to the shaft 27*e*.

In this way, it is possible to prevent abnormal noise due to contact between the fixed magnet member 27 and the developing roller 25 and prevent image defects due to defective rotation of the developing roller 25. There is no longer a danger of the developing roller 25 and the fixed magnet member 27 making contact with each other; this helps reduce a gap between the developing roller 25 and the fixed magnet member 27, and helps increase the magnetic force acting on the surface of the developing roller 25 and thereby prevent defective formation of the toner layer. Moreover, the magnetic force can be increased without making the developing roller 25 or the fixed magnet member 27 larger, and this contributes to reducing the size and cost of the developing device 4.

In this embodiment, rubber magnets in the same shape are used as the N1 pole 27*b* and the N2 pole 27*d*, and are arranged in axial symmetry with respect to the shaft 27*e*; this helps prevent the shaft 27*e* from warping due to thermal deformation of the magnetic poles 27*a* to 27*d* more effectively.

Figure 6:
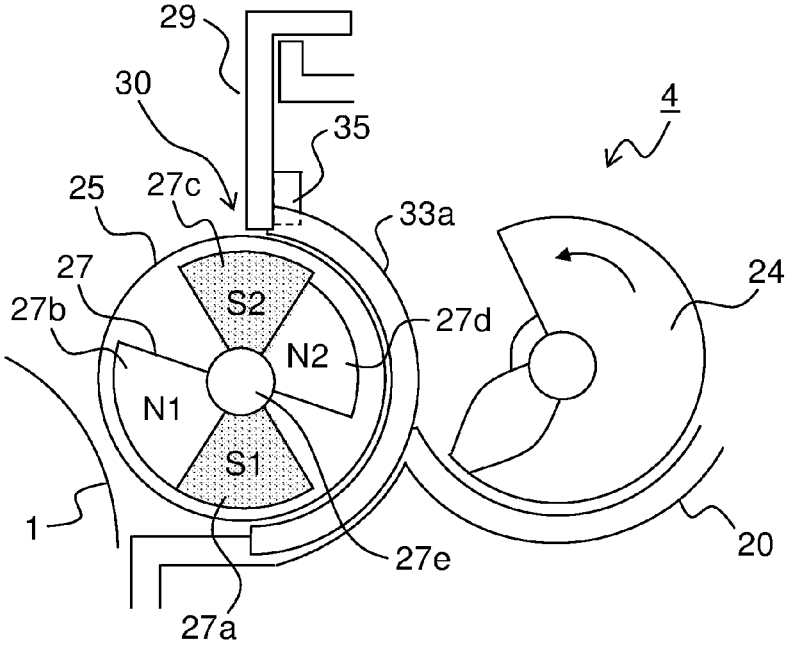
FIG. 6 is an enlarged view of and around a developing roller 25 in a developing device 4 according to a second embodiment of the present disclosure.

FIG. 6 is an enlarged view of and around the developing roller 25 in the developing device 4 according to a second embodiment of the present disclosure. In this embodiment, of the magnetic poles 27*a* to 27*d* fixed to the shaft 27*e*, as the S1 pole 27*a* and the S2 pole 27*c*, plastic magnets in the same shape are used, and these are arranged in axial symmetry with respect to the shaft 27*e*. On the other hand, as the N1 pole 27*b* and the N2 pole 27*d*, rubber magnets are used, and these have shapes different from each other: the N2 pole 27*d* has a radius smaller than that of the N1 pole 27*b*. In other respects, the structure of the developing device 4 here is similar to that in the first embodiment, and therefore no overlapping description will be repeated.

Also in this embodiment, when the S1 pole 27*a* and the S2 pole 27*c* expand or contract due to change in temperature, as in the first embodiment, a force acts on the shaft 27*e* uniformly from axisymmetric directions (up/down directions in FIG. 5). As a result, the shaft 27*e* can be prevented from warping due to thermal deformation of the magnetic poles 27*a* and 27*c*. Thus, defective formation of the toner layer can be prevented. Moreover, the magnetic force can be increased without making the developing roller 25 or the fixed magnet member 27 larger, and this contributes to reducing the size and cost of the developing device 4.

In this embodiment, the N1 pole 27*b* and the N2 pole 27*d* implemented with rubber magnets are not arranged in axial symmetry. Rubber magnets, however, have a smaller thermal expansion coefficient than plastic magnets, and are therefore less likely to deform thermally; there is thus no danger of the shaft 27*e* warping and thereby causing the fixed magnet member 27 and the developing roller 25 to make contact with each other. That is, arranging at least an even number of plastic magnets in axial symmetry with respect to the shaft 27*e* helps prevent the shaft 27*e* from warping due to thermal deformation of the plastic magnets.

Figure 7:
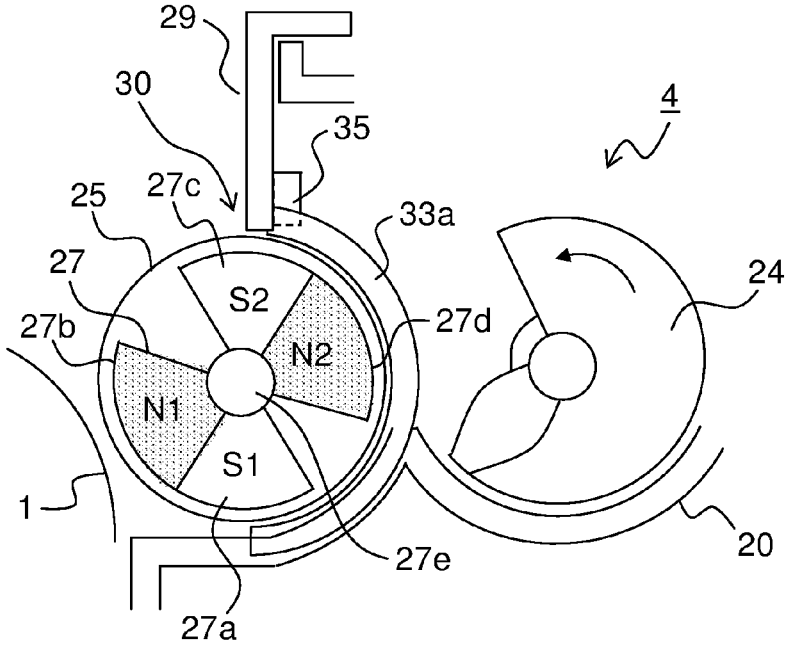
FIG. 7 is an enlarged view of and around a developing roller 25 in a developing device 4 according to a third embodiment of the present disclosure.

FIG. 7 is an enlarged view of and around the developing roller 25 in the developing device 4 according to a third embodiment of the present disclosure. In this embodiment, the developing device 4 adopts a two-component developing system that uses two-component developer containing magnetic carrier and toner as developer. In the developing device 4 adopting the two-component developing system, the two-component developer is carried on the developing roller 25 to form a magnetic brush, and the magnetic brush is brought into contact with the photosensitive drum 1 to develop an electrostatic latent image formed on the photosensitive drum 1.

In the developing device 4 adopting the two-component developing system, delivery of toner from the developing roller 25 to the photosensitive drum 1 is important, and thus the N1 pole (main pole) 27*b* of the fixed magnet member 27 is required to have a strong magnetic force. Accordingly, in this embodiment, plastic magnets in the same shape are used as the N1 pole 27*b* arranged at a position where the photosensitive drum 1 and the developing roller 25 are close together and as the N2 pole 27*d* arranged opposite the N1 pole 27*b* across the shaft 27*e*, and are arranged in axial symmetry with respect to the shaft 27*e*. In this way, as in the first and second embodiments, the shaft 27*e* can be prevented from warping due to change in temperature.

Figure 8:
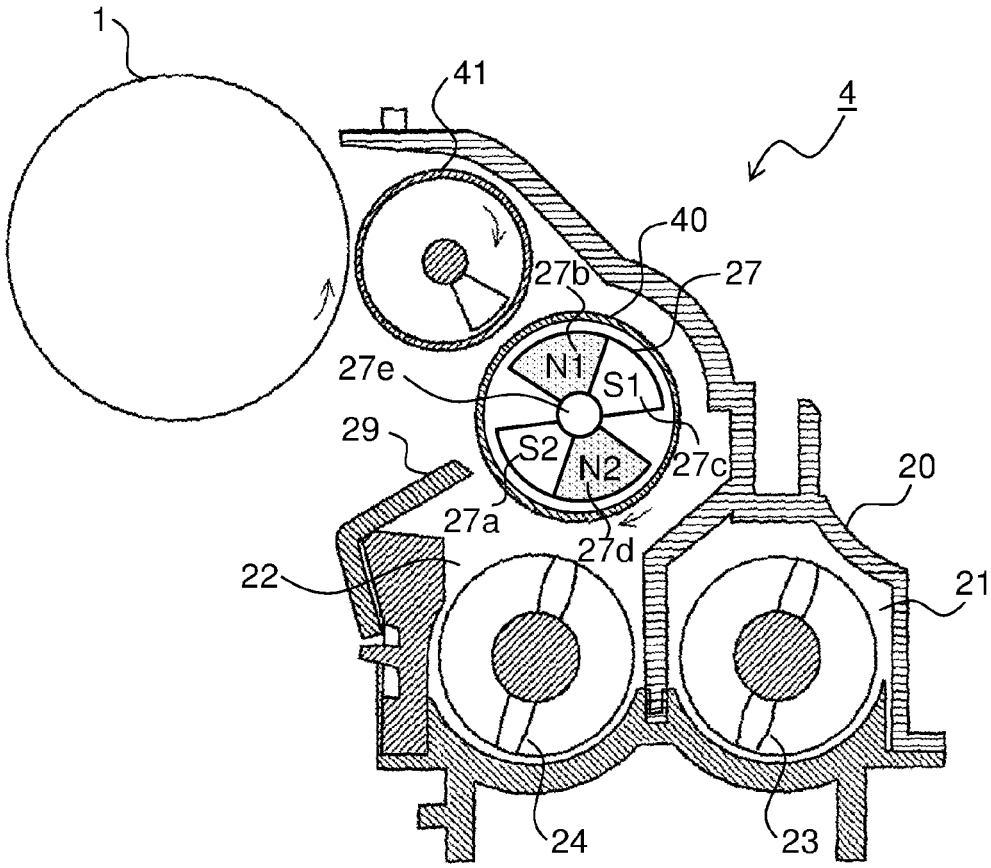
FIG. 8 is a side sectional view of a developing device 4 according to a fourth embodiment of the present disclosure.

FIG. 8 is a side sectional view of the developing device 4 according to a fourth embodiment of the present disclosure. In this embodiment, the developing device 4 is provided with a magnetic roller (developer carrying member) 40 and a developing roller (toner carrying member) 41, wherein two-component developer is carried on the magnetic roller 40 to form a magnetic brush; while magnetic carrier is left behind, toner alone is transferred onto the developing roller 41, thereby forming a thin layer of toner; and the toner is attached to an electrostatic latent image on the photosensitive drum 1 by an AC electric field.

In this embodiment, delivery of toner from the magnetic roller 40 to the developing roller 41 is important, and thus the N1 pole (main pole) 27*b* of the fixed magnet member 27 fixed in the magnetic roller 40 is required to have a strong magnetic force. Accordingly, in this embodiment, plastic magnets in the same shape are used as the N1 pole 27*b* arranged at a position where the developing roller 41 and the magnetic roller 40 are close together and as the N2 pole 27*d* arranged opposite the N1 pole 27*b* across the shaft 27*e*, and are arranged in axial symmetry with respect to the shaft 27*e*. In this way, as in the first to third embodiments, the shaft 27*e* can be prevented from warping due to change in temperature.

The embodiments described above are in no way meant to limit the present disclosure, which thus allows for many modifications and variations within the spirit of the present disclosure. For example, although the above-described embodiments deal with a fixed magnet member 27 comprising four poles, namely two N poles and two S poles, the present disclosure is applicable equally to a fixed magnet member 27 comprising five or three poles. Below, by way of practical examples, the effects of the present disclosure will be described more specifically.

Practical Example

The relationship between arrangement of plastic and rubber magnets used as magnetic poles of the fixed magnet member 27 and the amount of deformation of the shaft 27*e* was examined. The following developing devices were tested: a developing device 4 (Practical Example 1) according to the first embodiment, in which, as shown in FIG. 4, plastic magnets in the same shape were used as the S1 pole 27*a* and the S2 pole 27*c* and were arranged in axial symmetry with respect to the shaft 27*e*, and rubber magnets in the same shape were used as the N1 pole 27*b* and the N2 pole 27*d* and were arranged in axial symmetry with respect to the shaft 27*e*; a developing device 4 (Practical Example 2) according to the second embodiment, in which, as shown in FIG. 6, plastic magnets in the same shape were used as the 51 pole 27*a* and the S2 pole 27*c* and were arranged respectively in axial symmetry with respect to the shaft 27*e*, and rubber magnets having mutually different radii were used as the N1 pole 27*b* and the N2 pole 27*d*; and a developing device 4 (Comparative Example), in which, as shown in FIG. 9, a plastic magnet was used only as the S2 pole 27*c*, and rubber magnets were used as the S1 pole 27*a*, the N1 pole 27*b*, and the N2 pole 27*d*.

In Practical Example 1, the plastic magnets used as the S1 pole 27*a* and the S2 pole 27*c* and the rubber magnets used as the N1 pole 27*b* and the N2 pole 27*d* all had the same magnet height (radius) of 8.7 mm. In Practical Example 2, the plastic magnets used as the S1 pole 27*a* and the S2 pole 27*c* and the rubber magnet used as the N1 pole 27*b* had a magnet height (radius) of 8.7 mm, and the rubber magnet used as the N2 pole 27*d* had a magnet height (radius) of 8.2 mm. In Comparative Example, the plastic magnet used as the S2 pole 27*c* had a magnet height (radius) of 8.7 mm, the rubber magnets used as the S1 pole 27*a* and the N2 pole 27*d* had a magnet height (radius) of 8.2 mm, and the rubber magnet used as the N1 pole 27*b* had a magnet height (radius) of 8.7 mm.

In Practical Examples 1 and 2 and Comparative Example, the shaft 27*e* had an outer diameter of 6 mm, and the sleeve of the developing roller 25 had an outer diameter of 20 mm, an inner diameter of 18.4 mm, and a thickness of 0.8 mm. The gap (clearance) between the developing roller 25 on the S2 pole 27*c* side and the fixed magnet member 27 was 0.5 mm, and the bonding width over which the plastic and rubber magnets and the shaft 27*e* were bonded together was 100 mm.

With each of the developing devices 4 of Practical Examples 1 and 2 and Comparative Example, while its temperature was increased by 20° C., the amount of deformation of the shaft 27*e* was measured. Table 1 shows the results.

TABLE 1

| | Practical Example 1 | Practical Example 2 | Comparative Example |
|---|---|---|---|
| Thermal (20° C. rise) Deformation (mm) | 0 | 0 | 0.2 |
| Deformation Due to Blade Magnetic Force (mm) | 0.2 | 0.2 | 0.2 |
| Deformation Due to Mechanical Variations (mm) | 0.2 | 0.2 | 0.2 |
| Total Deformation Amount (mm) | 0.4 | 0.4 | 0.6 |

The test results reveal the following. With the developing devices 4 of Practical Examples 1 and 2 both, although the shaft 27*e* exhibited a total deformation of 0.4 mm, including a deformation (0.2 mm) due to the magnetic force of the blade-side magnet 35 of the regulating blade 29 and a deformation (0.2 mm) due to mechanical variations, no contact was observed between the fixed magnet member 27 and the inner surface of the developing roller 25.

By contrast, with the developing device 4 of Comparative Example, the total deformation was 0.6 mm, including, a deformation (0.2 mm) due to the magnetic force of the blade-side magnet 35, a deformation (0.2 mm) due to mechanical variations, and in addition a thermal deformation (0.2 mm) due to the rise in temperature, and contact was observed between the fixed magnet member 27 and the inner surface of the developing roller 25.

It has thus been confirmed that, in the fixed magnet member 27 comprising an even number of plastic and rubber magnets as magnetic poles, arranging plastic magnets in the same shape in axial symmetry with respect to the shaft 27*e*, as compared with arranging plastic magnets not in axial symmetry, helps effectively suppress deformation of the shaft 27*e*.

The present disclosure is applicable to developing devices that use magnetic developer and to developer carrying members used therein. Based on the present disclosure, it is possible to provide a developing device and a developer carrying member that can prevent thermal deformation of a shaft of a fixed magnet member arranged in the developer carrying member, and that can effectively prevent abnormal noise and image defects resulting from contact between the developer carrying member and the fixed magnet member.

What is claimed is:

1. A developing device for developing an electrostatic latent image formed on an image carrying member, comprising:

a housing containing magnetic developer;

a developer carrying member rotatably supported on the housing, the developer carrying member carrying the developer on a circumferential surface thereof; and a magnet member having a shaft fixed inside the developer carrying member and a plurality of developer carrying member-side magnetic poles fixed to the shaft in a circumferential direction thereof, an even number of the developer carrying member-side magnetic poles being formed by plastic magnets, one or more other of the developer carrying member-side magnetic poles being formed by rubber magnets, one or more pairs of the plastic magnets located opposite each other across the shaft having a same shape and being fixed in axial symmetry with respect to the shaft, wherein the developer carrying member carries magnetic one-component developer containing magnetic toner, further comprising a regulating blade arranged across a predetermined gap from the developer carrying member and formed of a magnetic material, and wherein the developer carrying member-side magnetic poles of the magnetic member comprise a regulating pole arranged at a position where the developer carrying member and the regulating blade are close together and a magnetic pole arranged opposite the regulating pole across the shaft, these two poles being formed by the plastic magnets having the same shape and being fixed in axial symmetry with respect to the shaft.

2. The developing device of claim 1, wherein the magnet member comprises an even number of the rubber magnets, one or more pairs of the rubber magnets located opposite each other across the shaft having a same shape and being fixed in axial symmetry with respect to the shaft.

3. An image forming apparatus comprising the developing device of claim 1.

* * * * *